United States Patent [19]

Bilgrei

[11] 3,979,569

[45] Sept. 7, 1976

[54] WATER LEVEL SENSING DEVICE HAVING RUPTURABLE HYGROSCOPIC-TYPE SWITCH ACTUATOR

[76] Inventor: Michael Bilgrei, 111-20 73rd Ave., Forest Hills, N.Y. 11375

[22] Filed: July 28, 1975

[21] Appl. No.: 599,479

[52] U.S. Cl. ..... 200/61.04; 73/335; 73/337.5; 200/61.06

[51] Int. Cl.[2] ..... H01H 35/18

[58] Field of Search ..... 200/61.04–61.08; 73/335–337.5

[56] References Cited

UNITED STATES PATENTS

| | | | |
|---|---|---|---|
| 2,191,630 | 2/1940 | Shutts | 200/61.06 |
| 3,091,674 | 5/1963 | Harris | 200/61.06 |
| 3,115,557 | 12/1963 | Kjellman | 200/61.06 |
| 3,123,687 | 3/1964 | Kjellman et al. | 200/61.06 |
| 3,142,610 | 8/1964 | Gustafson | 200/61.06 |
| 3,163,729 | 12/1964 | Flagg | 200/61.06 X |
| 3,243,536 | 3/1966 | Hansen | 200/61.04 X |
| 3,288,961 | 11/1966 | Thompson | 200/61.06 |

*Primary Examiner*—James R. Scott
*Attorney, Agent, or Firm*—Howard C. Miskin

[57] ABSTRACT

A water level sensing device includes a housing having a bottom opening and a micro-switch mounted in the housing above its bottom and provided with a spring loaded horizontally projecting actuating arm. An upper support arm depends from the actuating arm and terminates in a horizontal leg and a bottom horizontal arm is vertically adjustably supported on a wall of the housing below the horizontal leg. A loop of water absorbent paper is engaged and stretched between the horizontal arm and leg and retains the switch arm in actuated position until the loop is wetted and weakened to rupture and releases the switch arm to a deactuated position.

6 Claims, 3 Drawing Figures

WATER LEVEL SENSING DEVICE HAVING RUPTURABLE HYGROSCOPIC-TYPE SWITCH ACTUATOR

BACKGROUND OF THE INVENTION

The present invention relates generally to improvements in liquid level sending devices and it relates more particularly to an improved device which responds to the accumulation of water reaching a predetermined level.

Many devices have been heretofore employed and proposed which sense or respond to the water level in a monitored area such as a computor room, machine shop, cellar, basement, sump well or the like reaching a predetermined level, such devices functioning to control a discharge drain or sump pump motor or a signal or alarm devices. These water level sensing devices are generally of a mechanical nature including a float, the raising of which actuates a switch. However, by reason of the mechanical nature of the devices, they are not entirely reliable, frequently malfunctions and is complicated, bulky and of little versatility. Other water level sensing devices of a non-mechanical nature are usually expensive and complex and also frequently unreliable.

SUMMARY OF THE INVENTION

It is accordingly a principal object of the present invention to provide an improved liquid sensing device.

Another object of the present invention is to provide an improved adjustable water level sensing device.

Still another object of the present invention is to provide an improved sensing device which actuates a switch in response to the water in a monitored area, such as the flow of a liquid in a machine room, basement, cellar, sump well or the like reaching a predetermined level.

A further object of the present invention is to provide a device of the above nature characterized by its reliability, simplicity, low cost, ruggedness, and great versatility and adaptability.

The above and other objects of the present invention will become apparent from a reading of the following description taken in conjunction with the accompanying drawing which illustrates a preferred embodiment thereof.

In a sense the present invention contemplates the provision of an improved water level sensing device, particularly useful on floor or well base areas and which comprises a housing having a bottom opening, a microswitch mounted in and above the bottom of the housing and including a horizontally extending actuating arm swingable between advanced depressed and retracted raised positions and resiliently urged to its retracted position, a loop formed of a material having relatively low wet and high dry strengths, and means for supporting the loop in the housing in a vertically extending position, between the switch actuating arm and an underlying point to retain the switch actuating arm in its advanced position, the stress of the switch actuating arm on the loop exceeding the wet strength thereof so as to rupture the loop when the loop is wet and effect the retraction of the actuating arm.

The loop is advantageously formed of a water absorbent paper, preferably blotting paper, and the loop supporting means, in its preferred construction, includes a support arm depending from the switch actuating arm and terminating in an upper horizontal leg engaging the upper part of the loop and a lower horizontal leg which is vertically adjustable and engages the lower part of the loop. A junction box is secured to the housing, and conductors extend from the switch through the junction box to a signal device, motor control circuit or the like.

The improved water level sensing device is highly reliable and is insensitive to slight moisture conditions, as typified by the conditions accompanying the washing or mopping of the floor being monitored. The device is simple, compact and rugged and easily adjustable and is of great versatility and adaptability.

DESCRIPTION OF THE PREFERRED EMBODIMENT

Figure 1:
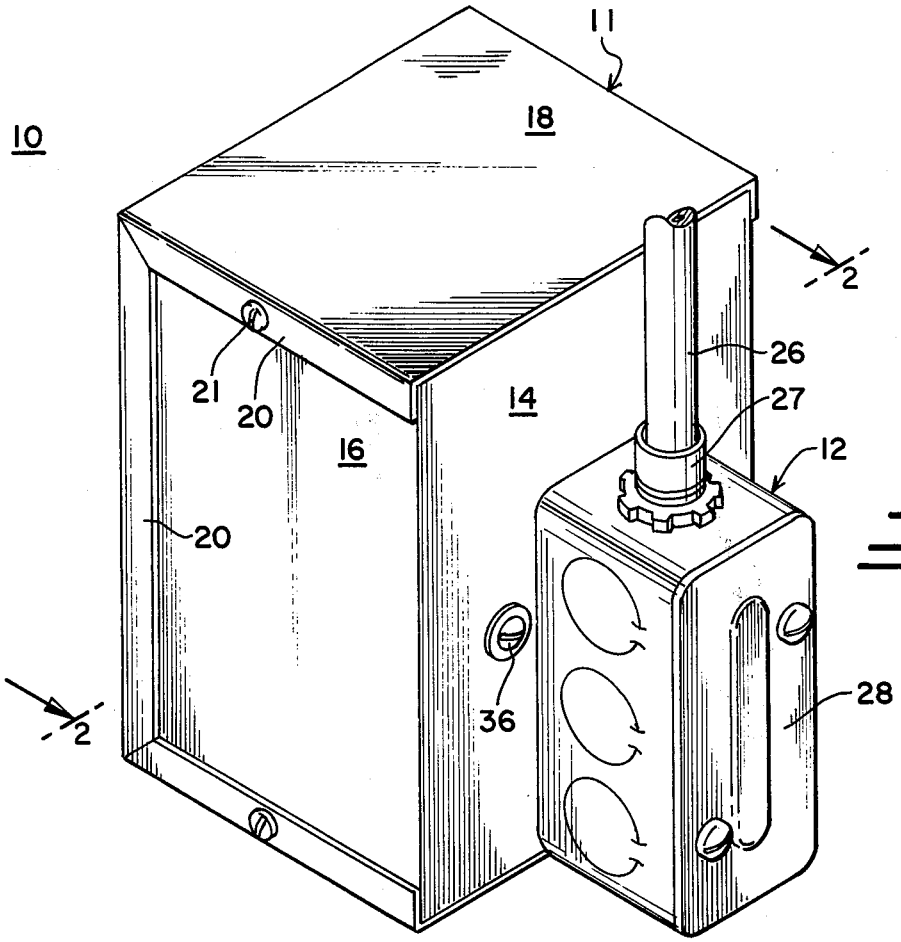
FIG. 1 is a perspective view of a water level sensing device embodying the present invention.
Figure 2:
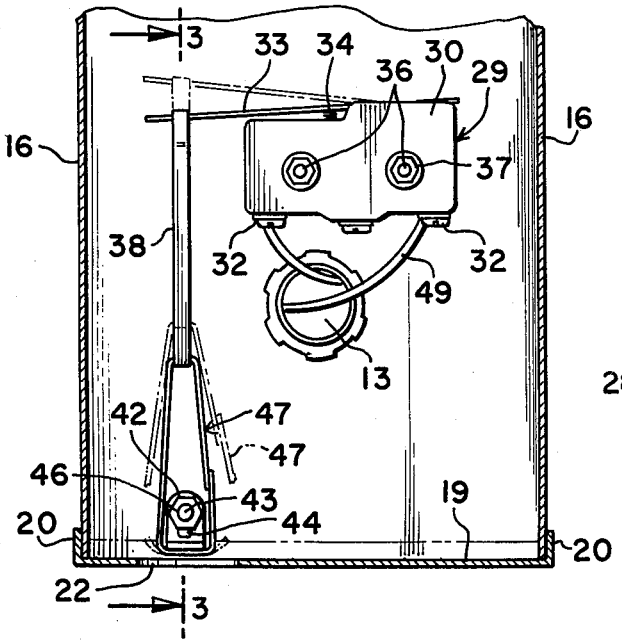
FIG. 2 is a sectional view taken along line 2—2 in FIG. 1.
Figure 3:
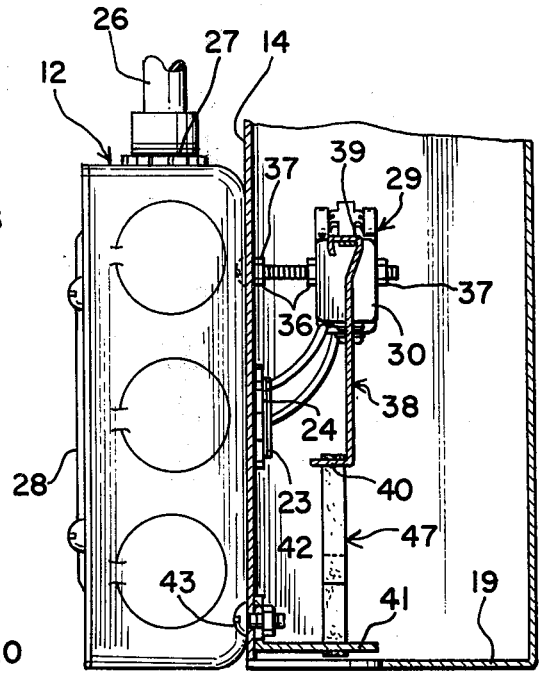
FIG. 3 is a sectional view taken along line 3—3 in FIG. 2.

Referring now to the drawing which illustrates a preferred embodiment of the present invention, the reference numeral 10 generally designates the improved water level sensing device which includes a main sheet metal box or housing 11 and a conventional junction box 12 joined end to end with the housing 11 and of lesser width than the housing, the junction box communicating with the housing through aligned openings 13 in their abutting walls.

The housing 11 includes a rear rectangular end wall 14 having an opening 13 formed therein and rectangular parallel side walls 16 integrally formed at the side edge of rear wall 14. In addition, housing 11 includes a front wall 17 and horizontal top and bottom rectangular walls 18 and 19 respectively integrally formed therewith, the top and bottom wall and the front wall side edges having inwardly directed flanges 20 abutting the corresponding outside borders of side walls 16 and separably secured thereto by screws 21 to permit access to the interior of housing 11. Formed in the housing bottom wall 19 proximate a side wall 16 and extending to the rear wall 14 is a water access opening 22.

The junction box 12 is of conventional construction and has a vertical inner wall abutting the housing wall 14 and secured thereto by a threaded collar 23 and a mating nut 24 abutting the inside face of housing wall 14. The junction box 12 is provided at its top with an exit opening through which a multiconductor cable 26 passes by way of a suitable coupling member 27. Access to the interior of the junction box 12 is provided through a removable end cover plate 28.

A conventional microswitch 29 is located in the housing 11 above the opening 13 and in vertical alignment with and laterally offset from the bottom opening 22 and includes a laterally extending horizontal body member 30 housing the switch contacts and switch arm in the known manner and provided on its bottom face with screw terminals 32 connected to the switch arm and contacts.

A switch actuating arm 33 is connected at its inner end to the upper part of body member 30 and extends horizontally laterally across body member 30 and beyond to a point in vertical alignment with opening 22, the switch actuating arm being either resilient or pivotally connected at its inner end to the body member 30.

The switch 29 includes a vertically movable actuating button 34 bearing on the underface of actuating arm 33 spaced from the pivot point of arm 33 and is spring biased to a raised switch deactuated position corresponding to the depression of button 34 actuating the switch. Thus switch 29 is actuated with the depression of actuating arm 33 and is released to its deactuated position with the release of actuating arm 33. The switch 29 is mounted on wall 14 by a pair of laterally spaced parallel screws 36 engaging aligned pairs of openings in wall 14 and switch body member 30 and secured thereto by suitably positioned nuts 37.

A support arm 38 depends vertically from the outer end of the actuating arm 33 and is provided at its upper end with a hook portion 39 which engages and is secure to the actuating arm 33. The lower end of support arm 38 terminates in a transversely/projecting upper horizontal support leg 40. A bottom transversely extending horizontal support leg 41 is disposed below and in vertical alignment with upper support leg 40 and above bottom opening 22 and terminates at its inner end in a vertical ear 42 abutting the housing rear wall 14 and vertically adjustable secured thereto by a screw 43 engaging a vertical slot 44 in the ear 42 and a bore in the rear wall 14 and releasably tightened by a nut 46 engaging screw 43. Thus the level of the bottom of support leg 41 is vertically adjustable by selectably loosening and tightening nut 46.

A loop 47 engages and extends about the upper and lower support legs 40 and 41 and is of sufficient dry strength and of such a length as to maintain the switch actuating arm 33 in its depressed switch actuating position. The loop 47 is formed of a material having a high dry strength and a low wet strength, for example, a water absorbent paper such as a blotting paper. The wet strength of the band forming the loop 47 is such that the stress imparted to the loop 47 by the upwardly biased actuating arm 33 is sufficient to rupture the loop 47 when the boad forming the loop is wetted. The loop may be formed by overlapping the ends of the looped bands and securing the overlapping ends such as with a water resistant adhesive.

A pair of conductors 49 connect a pair of the switch terminals 32, preferably the terminals which are closed when the switch 29 is deactivated, to corresponding conductors in the cable 26 by way of junction connectors in the junction box 12. The cable 26 is in turn connected to any suitable circuit for providing an audible or visible signal or for energizing a drain or discharge pump motor when the switch 29 is deactivated.

The operation of the water level sensing device 10 is clear from the above description.

Briefly, the sensing device 10 is located in the desired area with the bottom of the loop 47 positioned at the highest safe water level. As long as the loop 47 is dry, it retains the switch 29 in its contact open deactivated position. However, with a rise in the water level to that of the bottom of loop 47, the loop 47 is wetted, its strength quickly decreased and the loop ruptured under the influence of the upwardly biased switch actuating arm 33. As a consequence the switch 29 is deactuated the switch terminals closed and the signal and/or pump actuated. To reset the device 10 the housing 11 is opened by removing screws 21 and the ruptured loop 47 is replaced by a dry loop.

It should be noted that an important feature of the sensing device 10 is the provision of the housing 11 which shields the sensing loop 47 from any water except the water level to be sensed and thereby prevents the spurious operation thereof.

While there has been described and illustrated a preferred embodiment of the present invention, it is apparent that numerous alterations, omissions and additions may be made without departing from the spirit thereof.

What is claimed is:

1. A water level sensing device comprising a housing having a bottom opening therein, a microswitch disposed in said housing and including a horizontally extending actuating arm swingable between advanced depressed and raised retracted positions and resiliently urged to its retracted position, a loop formed of a material having relatively low wet and relatively high dry strengths, and means for supporting said loop in said housing in a vertically extending position between said actuating arm and an underlying point to retain said arm in its advanced position, the stress of said actuating arm being imparted to said loop and exceeding the wet strength and being less than the dry strength of said loop whereby to rupture said loop when wet, and effect the switch actuating retraction of said actuating arm only with the rupture of said loop.

2. The sensing device of claim 1 wherein said loop material comprises a water absorbent paper.

3. The sensing device of claim 1 including means for adjusting the level of said loop.

4. The sensing device of claim 1 wherein said loop supporting means comprises a horizontally extending arm engaging the inside lower part of said loop and mounted in said housing vertically below said switch actuating arm.

5. The sensing device of claim 1 wherein said loop supporting means comprises an upper arm depending from said switch actuating arm and terminating at its bottom in a horizontally projecting leg engaging the inside upper part of said loop.

6. The sensing device of claim 1 including a junction box mounted on a wall of said housing and communicating with the interior thereof.

* * * * *